US006755315B1

(12) United States Patent
Mueller

(10) Patent No.: US 6,755,315 B1
(45) Date of Patent: Jun. 29, 2004

(54) BEVERAGE CAN WITH SIEVE CAP

(75) Inventor: Sebastian Frederic Mueller, Hamburg (DE)

(73) Assignee: Rainer Jonscher, Bad Doberan (DE); part interest ( * ) Notice: Subject to any disclaimer, the term of this patent is extended or adjusted under 35 U.S.C. 154(b) by 0 days.

(21) Appl. No.: 10/069,142

(22) PCT Filed: Aug. 17, 2000

(86) PCT No.: PCT/DE00/02799

§ 371 (c)(1),
(2), (4) Date: May 10, 2002

(87) PCT Pub. No.: WO01/12513

PCT Pub. Date: Feb. 22, 2001

(30) Foreign Application Priority Data

Aug. 17, 1999 (DE) ..... 299 14 412

(51) Int. Cl.[7] ..... B65D 51/18

(52) U.S. Cl. ..... 220/254.4; 220/254.1; 220/258.1; 220/258.3; 220/269; 220/270; 220/906

(58) Field of Search ..... 220/254.1–254.3, 220/258.1–258.5, 269, 270, 906, 730, 254.4; 222/153.01

(56) References Cited

U.S. PATENT DOCUMENTS 4,717,039 A * 1/1988 Ayyoubi ..... 220/253
5,269,432 A * 12/1993 Beckertgis ..... 220/253
5,720,412 A * 2/1998 Ficken ..... 220/730
5,775,534 A * 7/1998 Webb et al. ..... 220/269
5,887,742 A * 3/1999 Lewis ..... 220/730

FOREIGN PATENT DOCUMENTS

| | | | |
|---|---|---|---|
| DE | 39 31 573 A1 | * | 4/1991 |
| DE | 40 22 408 A1 | * | 1/1992 |
| DE | 40 38 329 A1 | * | 6/1992 |
| GB | 2304673 | * | 3/1997 |
| WO | WO 93/08087 | * | 4/1993 |

* cited by examiner

*Primary Examiner*—Robin A. Hylton
(74) *Attorney, Agent, or Firm*—Thomas M. Freiburger

(57) ABSTRACT

The invention relates to a beverage can with a press-in closure (2) whereby a lid area is surrounded by a separating line (3) which can be pressed down into a partial area by means of an actuation tab (4) of a grip lug (7) that is fixed to the lid (5) by means of a riveted joint (6), and forming a hole (8) in the interior of the can for pouring out said beverage. According to the invention, the hole (8) can be covered with a perforated external lid (9) which is also attached to the lid (5) by means of a riveted joint (6). When the grip lug (7) is actuated, the actuation tab (4) of the grip bracket (7) gets inserted into the perforated external cover (9) by means of a groove (10). The invention prevents insects such as wasps or the like from penetrating into the beverage can.

5 Claims, 4 Drawing Sheets

PRIOR ART

PRIOR ART

BEVERAGE CAN WITH SIEVE CAP

DESCRIPTION

Figure 1:
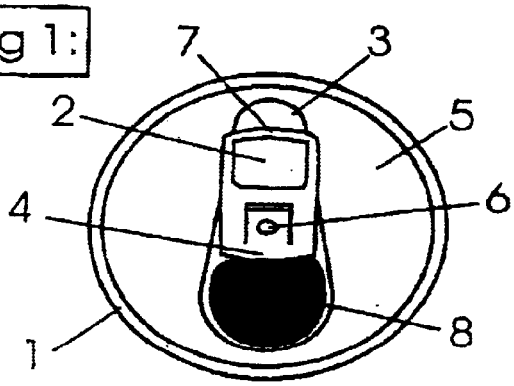

The invention concerns a beverage can with a press-in section in the top.

Today, drinks for refreshment are marketed not only in glass bottles or plastic containers, but also in cans. Cans are made from tinplate or, most recently, aluminum and are predominately furnished with a press-in top closure section. This section, when pressed in, breaks away a drinking opening in the top for access to the beverage. In particular, in the case of carbon dioxide containing drinks, the corresponding beverage cans must be quickly emptied, since, otherwise, too much carbonic acid is lost through the said drinking opening, which, as a rule, can cannot be closed again.

In DE 39 31 573 C2, a proposal has already been made, of reclosing the drinking opening after the opening of the can. This is done by means of a stopperlike closure element, which is attached to the press-in top flap. Such closure elements have not succeeded in being accepted.

Generally, it is not necessary, after the opening of the can, to achieve a complete reclosure, but it usually suffices to cover the said drinking opening in such a sievelike manner, that no danger exists that insects, wasps, or the like, can enter in to the unseen interior of the can. In particular, the entry of wasps in the summer months is seen as particularly dangerous, since these, upon the next swallow, can find their way into the throat area of the drinker and by stinging can call forth serious damage to the health.

DE 40 38 329 discloses a beverage can with a top with a tear-open closure. In this case, on the underside of the can top, a sievelike flap for the drinking opening is provided, which is permeable for liquids, but a barrier for solid particulate. Upon the opening of the can, the top closure, which formed the drinking opening, presses a sieve linkage which is located underneath the top. This pressing, must be so far downward, that the depressed top closure releases the sievelike flap.

Subsequently, by a resetting force in the linkage, the sieve swings upward, and covers the drinking opening from below. Experience shows however, that with this type of a combination-flap of a drinking opening, the top closure in any case, must be pressed down to an extreme extent, to release the sieve, which is located underneath the top. Otherwise, the function of the sieve will not be carried out.

A similar design is made known by DE 40 22 408 A1, which shows the same disadvantage.

In the U.S. Pat. No. 5,720,412, a can, especially a beverage can, is described. This can has a top with a press-in top closure, in which the drinking opening, created by the opening of the can, is protected in a sievelike manner with a removable sievelike cover element. By lifting a gripping-lug of the top closure, which is fastened by means of a rivet onto the top of the can, the broken away top closure, which creates the drinking opening, is pressed into the interior of the can. In doing this, the gripping-lug is lifted to such an extent, that it stands at a right angle to the top of the can. The said removable sievelike cover is provided with a slit in a semicircular cutout, besides having a sievelike perforation. The removable, slitted cover, after the opening, is pressed to swing downward by the gripping-lug, which now stands perpendicular to the can top. The semicircular cutout, by this action, is aligned around a rivet, which fastens the top closure to the top of the can and the sievelike cover comes to lie over the drinking opening. Because of the resulting alignment about the rivet, the removable sievelike cover is fixed in its position.

This design demands that the removable sievelike cover must be delivered as a separate component, for which a special packing is required. The positioning of the removable sievelike cover on the beverage can must be carried out with great precision and appears as a somewhat intricate maneuver. Nevertheless, caution must be taken from a hygienic standpoint, upon the reuse of the said removable sievelike cover. Insofar as an intermediate cleansing has not been carried out, hygienics are a priority, since contamination and bacteria or other parasites accumulate on the surface of the removable sievelike cover and upon drinking the beverage, such impurities can find their way into the body of the person drinking.

WO 93/08087 discloses a beverage can, which has a tear-open top closure, which, by means of a lever for pulling off or pushing down, a drinking-opening can be formed. On the top of the beverage can, besides the said closure and an opening lug, a further screened cover is provided.

The said screened cover is pivotally fastened with a rivet on the top of the beverage can and, following the opening of the can, the said screened cover can be brought to overlay the drinking opening by rotation. In this way, a reliable barrier is made to exclude entry into the can by insects or small objects.

The screened cover can be placed on the upper side of the top of the can, or, alternatively, on the underside thereof. In this latter case, a four sided rivet is employed, so that the screened cover, upon the rotation of rivet, is itself rotated. To facilitate such rotation, the top closure is fastened to the rive.

In another embodiment, the top closure possesses a screen section, which can be employed for the covering of the drinking opening, so that an additional cover element can be eliminated. In this case, the top closure with the screen section can likewise be rotated to protect the created opening of the beverage can with the screened cover.

However, it is a disadvantage, that it has to be necessary, after the opening of the beverage can, that first a screen section of a closure element must be brought over the drinking opening by a twisting motion, in order that the said opening can be closed to the entry of insects. In this design, the danger exists, that especially children will neglect to close the drinking opening against insects, so that, in spite of all efforts to the contrary, insects can migrate into the interior of the can.

Thus, the purpose of the invention is, to offer a beverage can with a one-piece, press-in closure, and do so a with cost-effective and simple manufacture thereof, a high degree of functional security, ease of manipulation, assured hygiene, and wherein no additional costs for packaging labor and packing materials are called for This purpose is achieved by the invention described in claim 1. Advantageous improvements of the invention are to be found in the subordinate claims.

The invention concerns a beverage can with a press-in top closure, wherein a top section is defined within a separating line, and at least one partial area of said section forms a drinking opening in the top of the can, by means of the downward lever action of an end piece of a gripping lug secured to said top by means of a rivet. This opening is covered by means of an external sievelike cap. The actuation end of the gripping lug, when operated, penetratively inserts itself in a cutout of the sievelike cap. It is accord with the invention, that this sievelike cap, the size of which essentially corresponds to the area inside the above mentioned peripheral separation line, has, in the unopened state of the can, its own bordering rim which follows the course of the said surrounding peripheral indentation. Further the said cap is fastened to the top of the can by a rivet connection.

Different than in the state of the technology, in the case of this design of an sievelike cap of the drinking opening of a beverage can, no motion of said sievelike cap occurs, so that this remains stationary in its position and remains functionable, independent of the activation of the gripping lug.

For increasing of the stability of the sievelike cap, this possesses a raised rim, which, in the unopened state of the can, lies contiguous to the separation line of the can top, so that, especially when the separation line is found in the recessed top, no additional projecting elements appear in the top area of the can.

Advantageously, the sievelike cap is made of the same material as the can or the gripping lug. It can, however, if it is fabricated as a separate part, also be made of plastic. The sievelike cap can, for instance, be made as part of the gripping lug in one work step and can be fastened onto the can top.

Since, in the case of commercially conventional gripping lugs for beverage cans, the gripping lug is fastened to the can by means of a fastening fixture which also is riveted to the can, provision may be advantageously made to make the sievelike cap out of an extension of the fastening fixture.

This can be accomplished, in that after the stamping of an appropriately shaped gripping lug, such a back bend is made at the fastening fixture, that, relative to the rivet connection, the fastening fixture is aligned to one side while the sievelike cap, likewise in relation to the rivet connection, is aligned toward the oppositely situated drinking opening side.

For reasons of fabrication, it may be preferred, that the sievelike cap, by means of lateral bending linkages, be constructed in one-piece with the gripping lug in the area of its rivet connection and be fastened to the can top at that point.

The invention effectively prevents the entrance of insects into the opened can, while the fabrication is neither complicated nor cost intensive.

Figure 2:
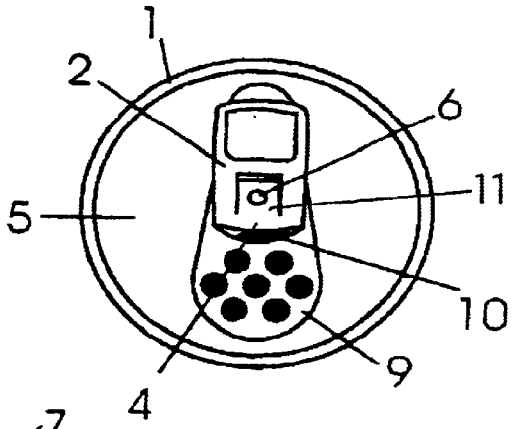
PRIOR ART Fig 2:
Figure 3:
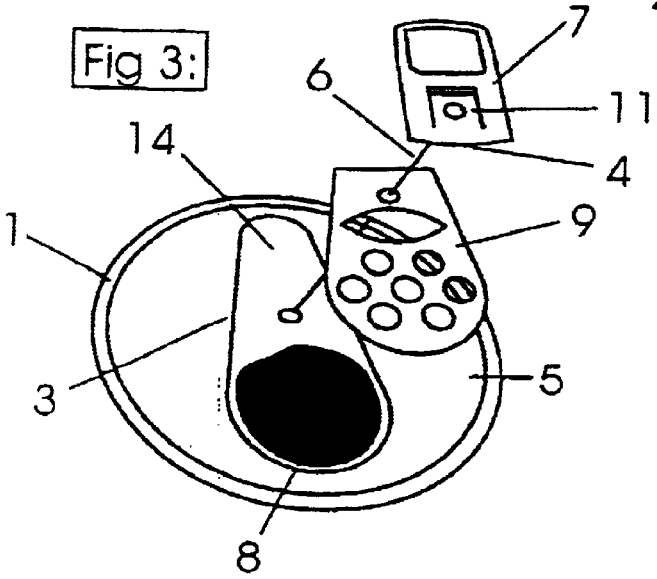
PRIOR ART Fig 3:
Figure 4:
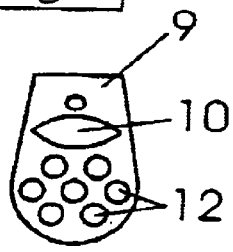
PRIOR ART Fig 4:
Figure 5:
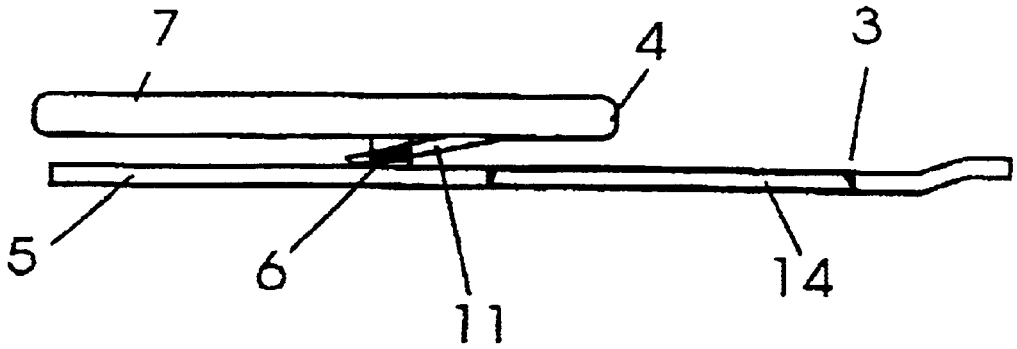
Fig 5: PRIOR ART
Figure 6:
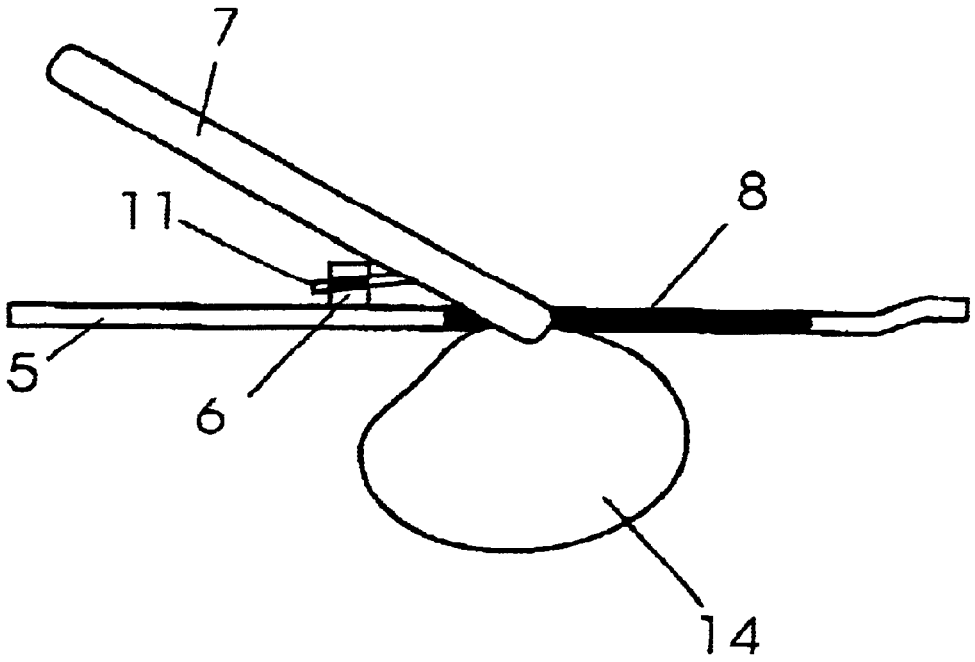
Figure 7:
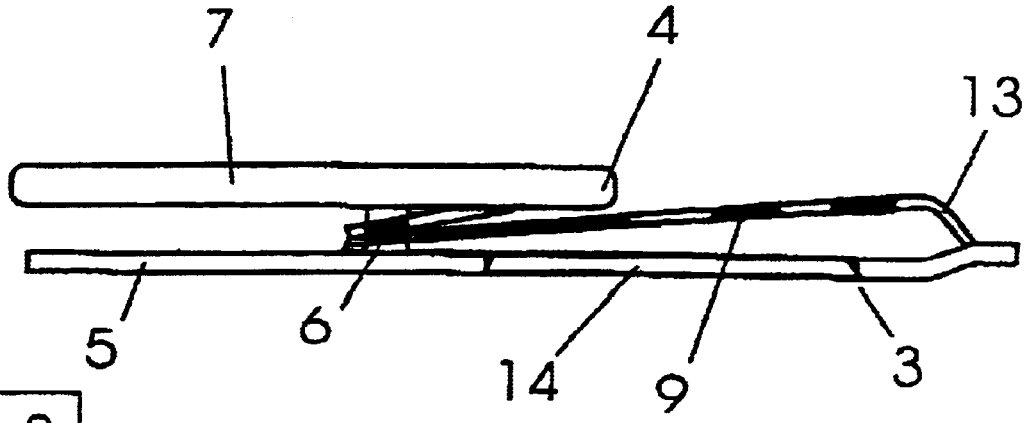
Figure 8:
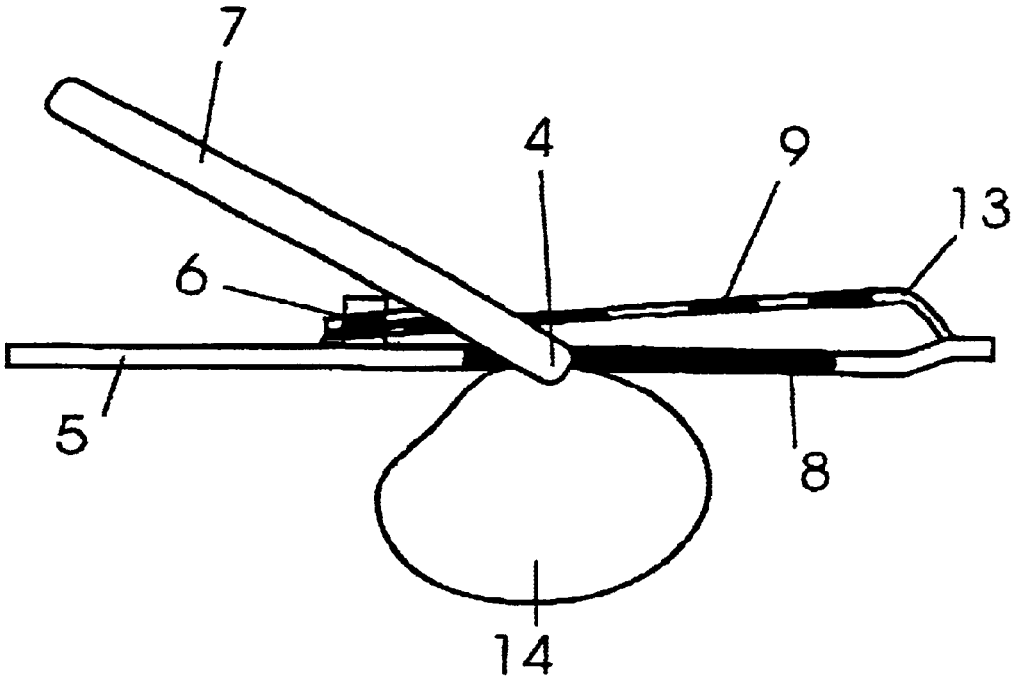
Figure 9:
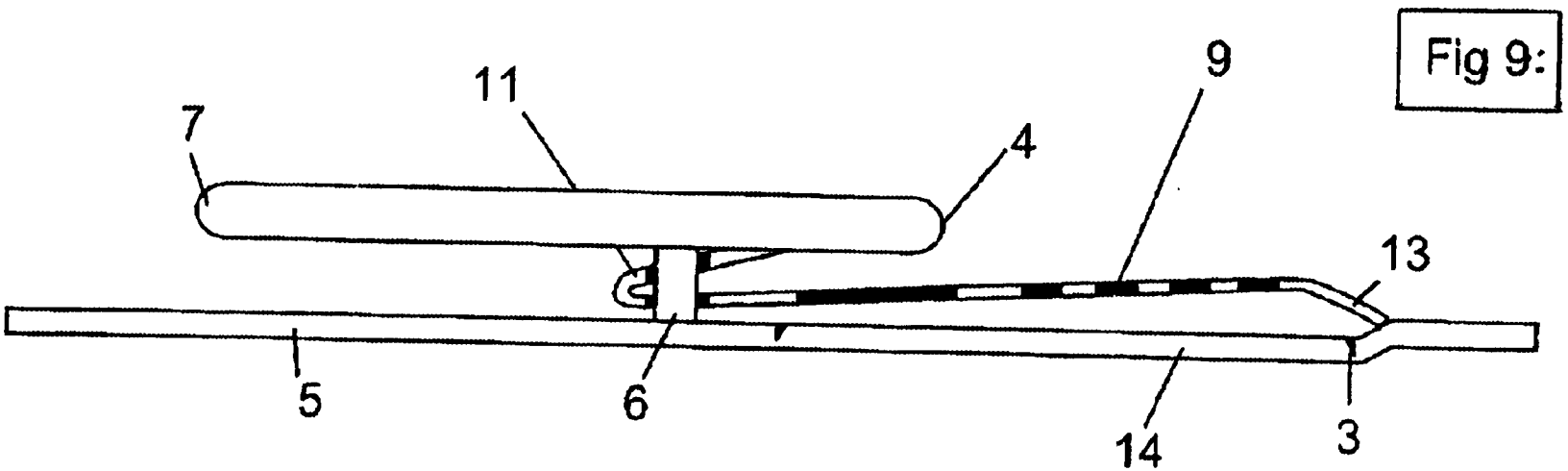

In the following, the invention will be more closely described with the aid of embodiment examples: There is shown in:

FIG. 1 a beverage can in accord with the state of the technology,

FIG. 2 a top view of a beverage can in accord with the invention,

FIG. 3 an exploded view of a beverage can in accord with the invention,

FIG. 4 a top view of a sievelike cap,

FIG. 5 the condition of a beverage can of the state of the technology in the closed state, FIG. 6 the condition of a beverage can of the state of the technology in the open state, FIG. 7 the condition of an invented beverage in the closed state, FIG. 8 the condition of an invented beverage can in the open state, and FIG. 9 a portion of the invented beverage can too showing a gripping lug with the sieve cap in a one-piece construction.

The view presented in FIG. 1 shows the top side of a beverage can 1 in accord with the state of technology. The can 1 includes a top 5, which is circumferentially joined to the remaining parts of the can. On the top 5 is found a press-in closure with a gripping lug 7, which, by means of a rivet connection is affixed at the center of the top 5 of the can. Upon drawing the gripping lug 7 upward, a lever end 4 presses down on a partial section of the top 5, which partial section is delineated by a separation line 3 from the rest of the top 5 area. By means of the press-in action of the lever end 4, the partial section within the separation line 3 is broken away from the rest of the top area and turned down, inward into the beverage can. Thereby, a drinking opening 8 is formed which, without further measures, cannot be closed again.

FIG. 2 depicts a design, in accord with the invention, which likewise shows a top 5, which, in turn, includes a press-in closure 2. This is again, as in FIG. 1, fastened with a rivet connection 6 to the top of the can. As before, an activation end 4 of the gripping lug 7 is provided, which, upon the elevation of said gripping lug 7, presses a partial section 14 of the top into the interior of the can 1.

Counter to the design shown in FIG. 1, the invented beverage can, in accord with FIG. 2, exhibits additionally a sievelike cap or sieve cap 9, which permanently covers over the drinking opening created by the press-in action of the activation end 4. With this arrangement the permeability of the sievelike cap 9 assures removal of liquid from the can. On the other hand, the sievelike cap 9 prevents the entry of insects, in particular wasps and the like, into the interior of the can.

The sievelike cap 9, together with the gripping lug 7, is fastened to the can top 5 by rivet connection 6, and said sievelike cap or sieve cap 9 has a cutout 10, into which the actuating end 4 of the gripping lug penetrates.

FIG. 3 shows, in exploded view, the objects of FIG. 2. From this FIG. 3 can be clearly seen, that, contrary to a can in keeping with the state of the technology, the invented can exhibits, between the can-top 5 and the gripping lug 7, a sievelike cap 9, which, by means of the rivet connection 6 is affixed to the top 5 of the can.

FIG. 4 presents, in an isolated detail, the sievelike cap (or sieve cap—terms used interchangeably) 9 which clearly points out, that the cap is a one-piece material object, for example, metal or plastic, which is penetrated by perforations 12 for the through-flow of a liquid. The cutout 10 serves for the penetrative entry of the actuation end 4 of the gripping lug 7.

The FIGS. 5 and 6 both show the opening of a beverage can in accord with the state of the technology. The gripping lug 7, by means of a fastening device 11 thereon, is attached by the riveted connection 6 to the top 5 of the can 1. Upon the lifting of the gripping lug 7, the activation end 4 of the gripping lug 7, exerts pressure on the partial area 14 of the top 5, so that this partial area 14, which, contrary to other areas of the can, breaks away at separation line 3, and turns down under said pressure into the interior of the can 1.

This action creates drinking opening 8. FIG. 6 depicts the corresponding state of an opened beverage can as per the state of the technology, showing the gripping lug in its raised position.

The FIGS. 7 and 8 show, on the other hand, the invented beverage cans, whereby, in FIG. 7 the closed position of the can 1 is depicted and in FIG. 8 the open condition is shown.

The sievelike cap 9 finds itself between the gripping lug 7 and the top 5, and is fastened, together with the gripping lug 7 onto the can top 5 by means of the rivet connection 6. So that the sievelikecap 9 lies close against the top 5, it is provided with a rim 13, which is situated somewhat in the area of, but preferably outside of, the separation line 3.

Upon the lifting of the gripping lug 7, the actuation end 4 thereof presses down on the separable partial section 14 of the top 5, so that the said partial section 14 breaks away into the interior of the can 1. Thereby, a drinking opening 8 is created. Because of the cutout 10 (see FIG. 4) the said actuation end 4 penetratively enters the sievelike cap 9, without moving or exerting pressure thereon. The sievelike cap 9, remains, for this reason, stationary at its position above the the drinking opening 8.

Drinking from the can is not prevented by the sievelike cap 9, since sufficiently large perforations 12 have been created, which allow the passage of liquids, while holding back insects and the like from entry into the beverage can. The perforations can be round, oval, quadratic or linear shaped.

In a developed embodiment of the invention, provision can be made, to fabricate the gripping lug 7 together with the sieve cap 9 in a one-piece construction. This would be carried out by having the fastening fitting 11 extending out directly to join the cap 9, or alternately, the sievelike cap 9 would be laterally fabricated onto the gripping lug 7. The former can be considered as an illustrated alternative in FIG. 2, in that the fastening fitting 11 can be viewed therein as contiguous to left and right with the sieve cap 9, which extends behind some portions of the gripping lug 7. FIG. 2 thus shows two alternatives. FIG. 9 shows the one-piece construction of the gripping lug 7 and the sieve cap 9, in a side elevation view with the sieve cap 9 shown in cross section. The sieve cap is of one-piece construction with the fastening fitting 11 and with the sieve cap 9.

REFERENCE NUMBERS AND ASSOCIATED OBJECTS

1 Beverage can
2 Press-in closure
3 Separation line
4 Actuation end of lug 7
5 Top of beverage can 1
6 Rivet connection
7 Lug for can opening
8 Opening in can top 5 for drinking
9 Sievelike cap
10 Cutout in sevelikecap 9 for lug end 4
11 Fastening fitting
12 Perforations in cap 9
13 Elevated rim on cap 9
14 Partial area of top 5 surface within periphery line 3

SUMMARY

The invention concerns a beverage can (1) with a press-in top closure (2), wherein at least one top area (14), defined within a peripheral separating line (3), can be pressed down into can interior by an actuating end (4) of a gripping lug (7), which said lug (7) is fastened by rivet connection (6) to said top (5) of can (1), wherein said pressing down thus creates a drinking opening (8) in the top (5) of the can (1). In accord with the invention, provision is made, that the drinking opening (8), can be covered by means of an external, sievelike cap (9), which said cap (9) is likewise fastened by said rivet connection (6). Upon the elevation of the gripping lug (7) the actuating end (4) of said gripping lug 7 penetrates through a cutout (10) of the sievelike cap (9). The invention prevents the invasion of insects, such as wasps or the like into the interior of the beverage can.

What is claimed is:

1. A beverage can with a press-in top closure, wherein at least one top area section, defined within a peripheral separating line, can be pressed down into the can interior by an actuating end of a gripping lug, which lug is fastened by rivet connection to said top closure of the can, thus creating a drinking opening in the top of the can which can be covered by means of an external, sieve cap and comprising a cutout in the sieve cap, positioned such that the actuation end of the gripping lug in operation penetrates the cutout to engage and press down said at least one top area section, the sieve cap in size essentially corresponding to said at least one top area section and having a peripheral rim, which in the unopened state of the can lies contiguous to the separating line on the top of the can, and wherein the sieve cap is fastened by means of the rivet connection to the top of the can.

2. A beverage can in accord with claim 1, wherein the sieve cap is comprised of metal or plastic.

3. A beverage can in accord with claim 1, wherein the sieve cap comprises a part of the gripping lug.

4. A beverage can in accord with claim 3, wherein the sieve cap is of one-piece with a fastening fitting of the gripping lug, which is fastened by the rivet connection to the can.

5. A beverage can in accord with claim 1, wherein the sieve cap exhibits round, square, or linear shaped perforations in said cap.

* * * * *